US005709526A

United States Patent [19]

McLeister et al.

[11] Patent Number: 5,709,526

[45] Date of Patent: Jan. 20, 1998

[54] SURGE RECURRENCE PREVENTION CONTROL SYSTEM FOR DYNAMIC COMPRESSORS

[75] Inventors: Larry D. McLeister, Fort Collins, Colo.; Gary W. Bostick, Danton, Tex.

[73] Assignee: Woodward Governor Company, Loveland, Colo.

[21] Appl. No.: 582,101

[22] Filed: Jan. 2, 1996

[51] Int. Cl.[6] ..... F04D 27/02

[52] U.S. Cl. ..... 415/1; 415/11; 415/17; 415/27; 364/431.02

[58] Field of Search ..... 415/1, 11, 17, 415/26–28, 47, 49, 50, 13, 118; 60/39.29; 364/431.02; 417/307

[56] References Cited

U.S. PATENT DOCUMENTS

| | | | |
|---|---|---|---|
| 4,142,838 | 3/1979 | Staroselsky . | |
| 4,486,142 | 12/1984 | Staroselsky . | |
| 4,697,980 | 10/1987 | Keyes, IV et al. . | |
| 4,831,534 | 5/1989 | Blotenberg . | |
| 4,949,276 | 8/1990 | Staroselsky et al. . | |
| 5,306,116 | 4/1994 | Gunn et al. | 415/27 |

OTHER PUBLICATIONS

P.p. 1 and 13–16 of "Compressor Antisurge Control" manual of Tri–Sen Co., Sep. 1993.

Excerpts from "Anti–Surge Control" manual of Dresser–Rand Control Systems. (no date).

"How to Cope with the High Speed of Approaching Surge", P. 5, Turbomachinery Maintenance, Jul., 1988.

"Basic TurboCompressor Control and Protection", Turbomachinery International, Jul./Aug. 1995.

"Benefits of the Series 3 Control System" from Series 3 Antisurge Controller Manual No. IM31 of Woodward Governor Co. (no date).

"Compressor Surge Prevention" by Larry McLeister in Turbonmachinery Control Conference, Aug. 7 to Aug. 10, 1995.

*Primary Examiner*—Christopher Verdier

*Attorney, Agent, or Firm*—Leydig, Voit & Mayer, Ltd.

[57] ABSTRACT

A control system prevents recurrence of surge in a dynamic compressor. An anti-surge valve bypasses flow and is operated by the control system between a low limit and a full open position. The low limit is initially established to be zero, or a fully closed anti-surge valve. In the event of a compressor surge, the system detects a position of the anti-surge valve at the onset of surge, and stores a position related to the detected position as a new low limit. The stored position is preferably the detected position plus a small increment in order to prevent recurrence of the surge event.

19 Claims, 3 Drawing Sheets

SURGE RECURRENCE PREVENTION CONTROL SYSTEM FOR DYNAMIC COMPRESSORS

FIELD OF THE INVENTION

The present invention generally relates to control systems for controlling the operation of dynamic compressors, and more particularly to control systems and methods for preventing surge in dynamic compressors.

BACKGROUND OF THE INVENTION

Dynamic compressors are widely used in industrial processes for providing compressed gas. In order to avoid interrupting the operation of a downstream process receiving the compressed gas, the operation of a dynamic compressor has to be well controlled to provide stable output pressure or flow rate as required by the downstream process. It is well known, however, that if the flow rate of a dynamic compressor drops below a certain threshold level for reasons such as changed conditions of the downstream process, surge and complete flow collapse can occur in the compressor. Besides the inevitable consequence of interrupting the downstream process, surge can also be a catastrophic experience for the dynamic compressor, causing audible retorts and strong vibrations in the compressor, which in serious cases can severely damage the dynamic compressor.

The threshold flow rate below which the dynamic compressor will experience surge is a function of the differential pressure across the dynamic compressor. The surge condition is often described using a compressor map that represents the operation of the compressor in terms of actual flow versus polytropic head. It has been found that surge will occur if the operating point of the compressor in the compressor map falls within a surge zone bordered by a surge line which is well approximated by a parabolic curve defined as:

$(\text{actual flow})^2 / (\text{polytropic head}) = K$, where K is a constant.

The commonly employed way for preventing a dynamic compressor from surging or to bring the compressor out of surge is to open an anti-surge valve connected to the output of the compressor. Most typically, the anti-surge valve bypasses flow from the compressor output to the input. Alternatively, the anti-surge valve can simply dump the output. Both are generically referred to herein as bypass. By increasing the bypass, the flow rate of the compressor is increased so that the operating point of the compressor is moved away from the surge region.

In order to effectively operate an anti-surge valve to prevent surge in a dynamic compressor, and to bring the compressor out of surge if a surge event should occur, control strategies have been developed to control the valve opening of the anti-surge valve according to the operating conditions of the dynamic compressor. Generally, valve opening control strategies that have been employed to date employ either a closed loop control process or a combination of a closed loop control process and an open loop control process. The closed loop control acts to control the anti-surge valve in a continuous closed loop fashion to adjust the flow of the compressor when the operating point of the compressor is undesirably close to the surge line. The closed loop control process is typically a proportional-integral-derivative (PID) control process which operates on a control variable corresponding to the position of the operating point of the compressor, and has a setpoint corresponding to a surge control line in the stable region of the compressor map.

The purpose of the open loop control process is to take over or assist if it appears that the closed loop control will be incapable of avoiding surge. If a surge backup point is exceeded, the open loop control process takes over the control of the anti-surge valve and rapidly opens it sufficiently wide to either prevent the surge event, if possible, or to bring the compressor out of surge, if surge has already commenced. After the operating point returns to the safe operating region, the open loop control process begins to close the anti-surge valve at either a fixed rate or a variable rate, and at some point in time the control of the anti-surge valve is returned to the closed loop process.

With the valve control strategies developed to date, there are many situations in which surge-control systems fail to prevent surge events. There are numerous reasons for such failures. For example, the failures may be due to faulty process assumptions, slow control dynamics for process upsets, inaccurate calculations, inaccurate process measurements or faulty sensors, input failures, inaccurate signal scaling, or changes in the compressor performance. Those problems have direct impact on the performance of the closed loop control processes, which typically use a process variable based on calculations using measured data of the compressor process conditions. Thus, there are conditions when closed loop surge strategies, even those which are sophisticated, being based on measured data, might not provide sufficiently accurate control, and might not be able to prevent surge.

In order to circumvent the problem of lack of accurate control in a closed loop control, one proposed method shifts the control setpoint of the closed loop control process after the recurrence of each surge event. The assumption is that if the surge control line corresponding to the new setpoint is set sufficiently far away from the surge region, adequate protection will be provided to prevent the compressor from surging again. However, if a surge event happens again, the setpoint will be shifted again to another presumed safe place. Presumably this process will be continued until the setpoint of the closed loop control has been moved sufficiently far to compensate for the causes of previous control system failure so that the closed loop control strategy can operate the compressor in a stable fashion.

Such a method for preventing recurrence of surge events has been ineffective in many cases, however. If the reason for a previous surge is slow dynamics, then moving the setpoint of the closed loop control may provide enough safety margin to prevent surge from recurring. On the other hand, if the previous surge is due to errors in process measurements or calculation of variables, surge may repeat in spite of the closed loop control strategy. To date, no control system, even if properly set up, is capable of preventing subsequent surges if there is a system error in the measurements, control dynamics, or calculation of process variables.

SUMMARY OF THE INVENTION

In view of the foregoing, it is a general aim of the present invention to provide an improved control system for use with a dynamic compressor that effectively prevents the recurrence of surge events.

To that end, it is an object of the present invention to provide a surge prevention control system for a dynamic compressor that is capable of preventing recurrence of surge events even if there are system errors in measurements, control dynamics, or calculation of process variables.

It is a related object of the present invention to provide a surge prevention control system that uses information derived from past surge events to adjust the control process to effectively prevent future surge events.

In accordance with those and other objects of the invention, there is provided a control system for use with a dynamic compressor for preventing recurrence of surge therein. The control system controls an anti-surge valve which is coupled to the output of the dynamic compressor for bypassing compressor flow. The control system includes a surge controller response to the operating point of the compressor for controllably opening the anti-surge valve from a minimum position to resist movement of the operating point into the surge region. The surge controller is operatively coupled to a surge limit memory for limiting the minimum position to a stored lower limit. A surge detector detects the onset of a surge event and operates in conjunction with the surge limit memory for storing a low limit corresponding to the valve opening at the onset of the surge event. The low limit is set to prevent recurrence of surge. In the preferred embodiment, the low limit is set at a small delta increment above the valve opening at the onset of surge to set a low limit which will prevent recurrence of the surge event.

It is a feature of the invention that the surge controller normally has a minimum anti-surge valve position of zero, but that minimum is increased in the event of a surge event to a level adequate to prevent recurrence of the surge event.

Thus, a feature of the invention is the modification of the output of the surge controller, without modifying the surge control line, by simply setting a low limit for the valve position which prevents the PID controller from closing the valve beyond the low limit.

Other objects and advantages will become apparent from the following detailed description when taken in conjunction with the drawings, in which:

Figure 1:
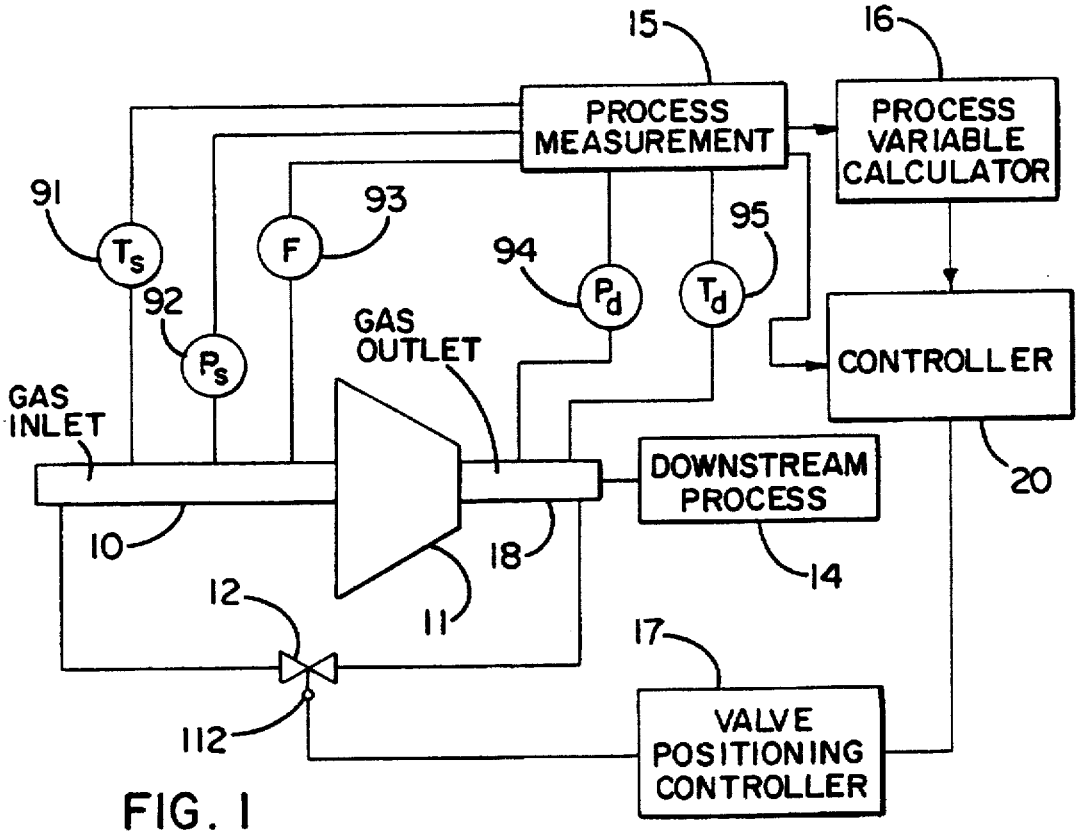
FIG. 1 is a block diagram showing a dynamic compressor with an anti-surge valve operated by a controller exemplifying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE INVENTION

Turning now to the drawings, FIG. 1 is a block diagram showing a dynamic compressor 11 coupled to a surge prevention control system exemplifying the present invention. The surge prevention control system utilizes an anti-surge valve 12 connected to the output of the dynamic compressor 11 to control the flow through the dynamic compressor 11. The anti-surge valve 12 has an adjustable opening which can be controlled by an electrical signal sent to a control input 112 of the anti-surge valve 12. When the anti-surge valve 12 is opened, a portion of the output of the dynamic compressor 11 is bypassed around the compressor 11. Bypassing flow around the dynamic compressor 11 increases the total flow through the dynamic compressor 11, which has the effect of moving the operating point away from the surge region. It will be appreciated that instead of recycling the gas from outlet to inlet as illustrated in FIG. 1, the flow of the dynamic compressor 11 can also be increased by simply dumping a portion of the output of the dynamic compressor 11 via the anti-surge valve 12. When the term "bypass" is used herein, unless the context indicates otherwise, it is intended to encompass both the preferred form of recycling, as well as the less preferred form of dumping.

To effectively prevent surge in the compressor while at the same time minimizing interference with the downstream process 14 which receives the compressed gas, the timing, duration, and degree of opening of the anti-surge valve 12 should be carefully controlled. As shown in FIG. 1, the valve opening is controlled by a controller 20 which adjusts the valve opening according to the process conditions of the compressor 11.

In accordance with the teaching of the present invention, the controller 20 is configured to control the valve opening of the anti-surge valve 12 between full open and a minimum valve opening to prevent surge in the dynamic compressor 11. As will be described in greater detail below, the minimum valve opening of the anti-surge valve 12 is established according to the valve opening at the onset of the last surge event. In other words, after a surge event occurs, the effective operating range of the anti-surge valve 12 is adjusted so that its opening can never be closed below a minimum valve opening. Preferably the minimum valve opening is set to be slightly larger than the valve opening at the onset of the surge event.

In more detail, gas is drawn through the compressor inlet to the compressor 11, and the compressed gas is passed to downstream process 14. To monitor the process conditions of the compressor 11, a plurality of sensors are disposed to sense the inlet and outlet conditions in the compressor 11. As illustrated in FIG. 1, the sensors typically include an inlet temperature sensor 91, an inlet pressure sensor 92, a flow sensor 93, a discharge pressure sensor 94, a discharge temperature sensor 95, and often include other types of sensors not shown here. The output signals of the sensors are sent to a process measurement module 15 which processes the output signals to determine the operating conditions of the compressor 11. The output of process measurement module 15 is coupled to a process variable calculator 16, which calculates one or more process variables which are used by the controller 20 to generate an output control signal. The output control signal is then used by the valve positioning controller 17 to adjust the valve opening of the anti-surge valve 12.

Figure 2:
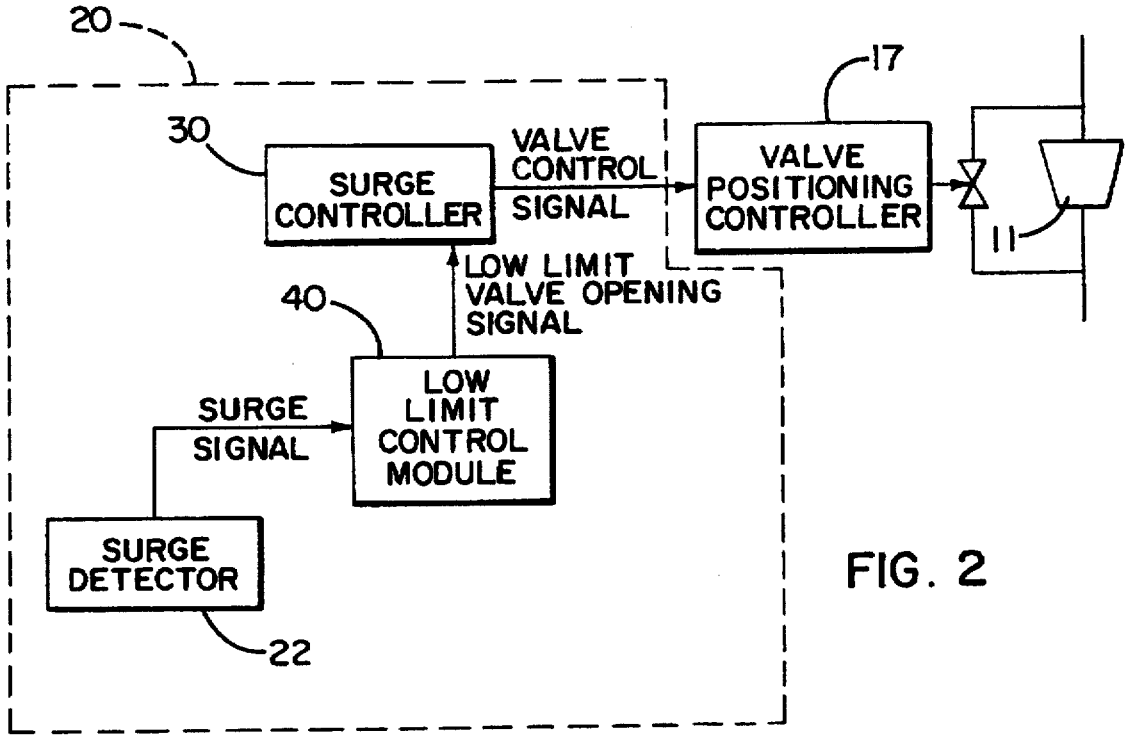
FIG. 2 is a block diagram showing a controller having a module for setting a minimum valve opening.

A block diagram illustrating the controller 20 is shown in FIG. 2. Generally, the controller 20 includes a surge controller 30 which controls the valve opening of the anti-surge valve 12 between full open and a minimum valve opening. The controller 20 normally maintains the anti-surge valve in a minimum position, preferably completely closed. If the operating point of the compressor approaches a surge condition, the surge controller 30 includes modules which open the anti-surge valve in an anti-surge cycle. Typically the surge controller 30 can be considered to have a quiescent condition in which the anti-surge valve 12 is maintained in a minimum position, and an anti-surge mode in which the anti-surge valve 12 is cycled open to resist the operating point from entering the surge region, then returned toward a minimum position.

However, as noted above, there will be times when the compressor 11 will enter the surge region and experience a surge. In order to prevent the compressor 11 from entering into repetitive surge cycles, the minimum valve opening is set by a low limit control module 40 according to the valve opening at the onset of the last surge event. To that end, a surge detector 22 monitors the process conditions of the dynamic compressor 11 to detect the onset of a surge event. Once the onset of a surge event is detected, the surge detector 22 generates a surge signal for triggering the module 40 to establish a new minimum valve opening according to the valve opening at the onset of the detected surge event. Once the dynamic compressor 11 is brought out of surge, the control module 30 continues to control the anti-surge valve 12 between full open and the new minimum valve opening to prevent future surge events from occurring.

It will be appreciated that by preventing the opening of the anti-surge valve 12 from being reduced below a properly set minimum opening, the cycles of surge events can be effectively broken. The closed loop surge prevention strategies in the prior art respond to a surge event by moving the setpoint of the closed loop control in order to prevent future surge events. If the calculations warrant valve closure, the closed loop control process allows the anti-surge valve 12 to be closed to a point that another surge cycle will commence, resulting in the perpetuation of cycles of surge events. This may happen regardless of any setpoint changes. In accordance with the teaching of the present invention, such cycle of surge events is broken by not allowing the anti-surge valve 12 to be closed down to the point that initiated the last surge event. Because the novel control scheme according to the present invention is independent of the closed loop operations, it provides adequate surge prevention even if the closed loop control strategy used has system errors due to, for example, erroneous process measurements, incorrect calculations, incorrect process assumptions, incorrect closed loop control strategy, or slow control dynamics.

In order to effectively prevent recurrence of surge events, it is important to correctly set the minimum valve opening position of the anti-surge valve 12. As pointed out above, allowing the valve to return to the closed position, or to some constant minimum position, will be ineffective, since the surge has shown that the closed loop controller is incapable of avoiding surge in all cases. We have also determined that setting the minimum valve opening to be the valve opening at the onset of the last surge event will be ineffective in many cases to break the cycle of future surge events, especially when the surge is related to system errors in the control process. In accordance with the invention, setting the minimum valve opening to be a small increment above the valve opening at the onset of the last surge event will effectively prevent subsequent surge events. The magnitude of such an increment necessary for preventing recurrence of surge events will generally depend on the valve characteristics, the process dynamics of the compressor, the system control response characteristics such as the lag time, etc. Furthermore, the proper increment also depends on the operational impact of a surge on the compressor 11. If two consecutive surges can cause severe damage to the compressor 11 or the downstream process 14 (FIG. 1), then the valve increment should be set very high to prevent a second surge from occurring. It has been found that an approach for setting such an increment of valve opening that yields satisfactory results is to set the increment as a fixed amount of valve opening. Preferably the fixed amount is between 5% and 10% of the full valve opening. It will be appreciated, however, that other ways of setting the increment of minimum valve opening over the valve opening at surge onset, such as using a variable percentage, or a fixed delta (Δ) increment can be employed without departing from the scope and spirit of the present invention.

Figure 3:
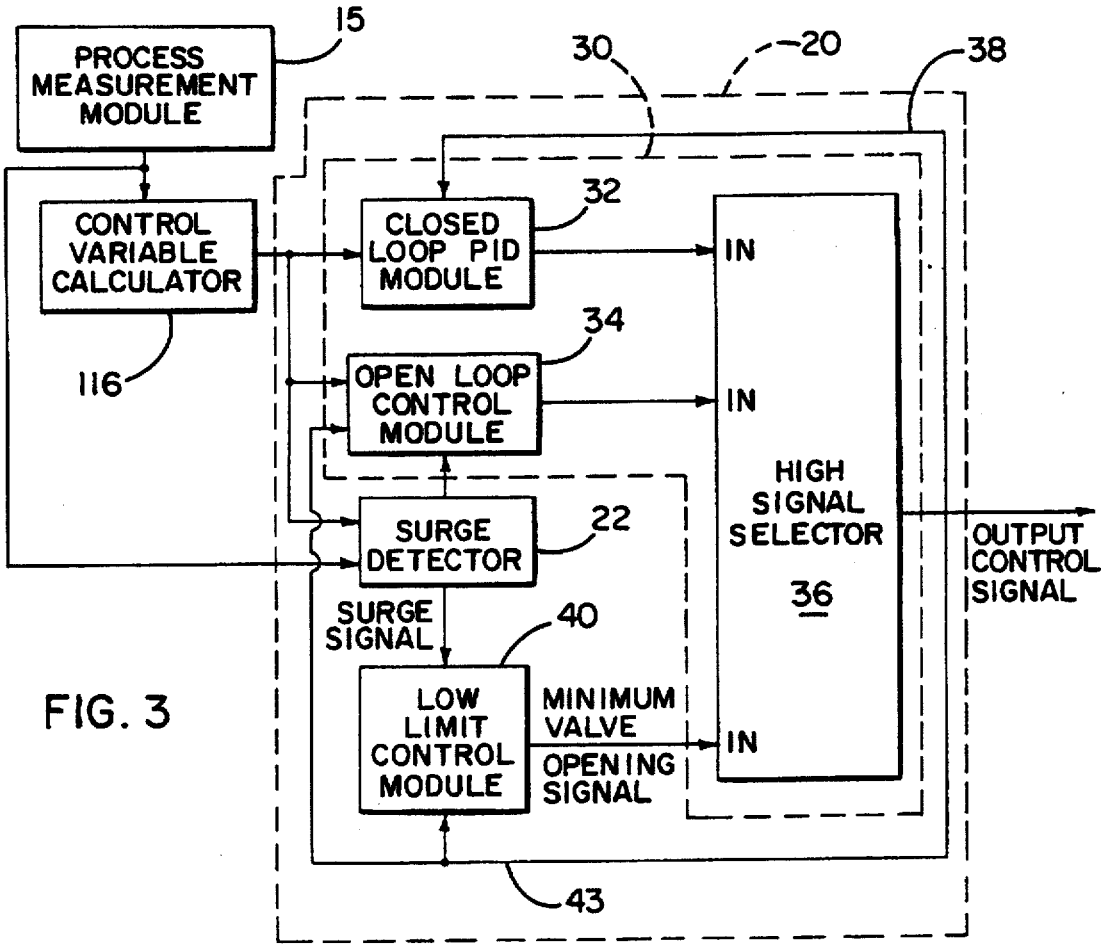
FIG. 3 is a block diagram showing an embodiment of the multiple module controller of FIG. 2.

FIG. 3 shows an embodiment of the controller 20 which employs a high signal selector to prevent the valve opening of the anti-surge valve 12 from being reduced below the minimum valve opening. The high signal selector 36 is used to ensure that the output control signal of the controller 20 always corresponds to a valve opening larger than or equal to the minimum valve opening set by the low limit control module 40.

As shown in FIG. 3, the high signal selector 36 is coupled to the low limit control module 40 for receiving a low limit valve opening signal which corresponds to the minimum valve opening. The high signal selector 36 is further coupled to other modules that generate control signals, each of which corresponds to a valve opening. For example, FIG. 3 shows a closed loop PID module 32 and an open loop control module 34 which generate, respectively, a PID control signal and an open loop control signal. It will be appreciated that other control modules using similar or different control strategies can also be coupled to the high signal selector 36. The high signal selector 36 receives the plurality of input control signals, including the low limit valve opening signal, and selects the input control signal that corresponds to the largest valve opening as the output control signal for controlling the anti-surge valve 12. In this way, the output control signal corresponds to a valve opening that is at least as large as the minimum valve opening set by the low limit control module 40. In other words, the low limit overrides the other controllers, including the PID, when they demand a valve opening which is below the low limit.

In more detail, in the present embodiment, the surge controller 30 uses a closed loop PID module to control the operating point of the dynamic compressor 11 when the operating point is close to the surge line. The process variable of the PID control module 32 is preferably a control variable that is defined as:

$$\text{Control variable}=(\text{actual flow})^2/\text{polytropic head}.$$

Defined in this way, each value of the control variable corresponds to a parabolic curve in the compressor map, and the setpoint of the PID module 32 defines a surge control line in the compressor map, which is typical disposed in the stable region of the compressor map. Digressing briefly to FIG. 5, there is shown a typical compressor map. A surge line 70 divides a stable operating region 73 from a surge region 74. A surge control line 71 is positioned in the stable operating region 73 and displaced by a slight distance from the surge line 70. The surge control line 71 typically serves as the set point for the surge control modules, which will act to control the operating point at the surge control line 71 if it attempts to enter the region between the surge control line 71 and the surge line 70.

In the present embodiment, and returning to FIG. 3, the control variable is calculated by the control variable calculator 116 using data generated by the process measurement module 15. The PID module 32 has proportional, integral, and derivative terms operating on the control variable to generate a PID control signal for controlling the opening of the anti-surge valve 12. The PID module 32 is tuned to open the anti-surge valve 32 when the operating point falls in the region between the surge line 70 and the surge control line 71 to resist the advance of the operating point toward the surge line 70. The PID module is typically configured in such a way that when the operating point is in the stable operating region 73 of the compressor map, the PID module 32 will generate a PID control signal to close the anti-surge valve 12. However, due to the operation of the high signal selector 36, a PID control signal that corresponds to a valve opening smaller than the minimum valve opening will not be selected for controlling the opening of the anti-surge valve 12.

Due to considerations of stability of control action, the closed loop PID module 32 generally does not have sufficiently quick response to prevent a rapidly occurring surge event. In the present embodiment, an open loop control module 34 is provided for the purpose of taking control in an attempt to prevent an imminent surge, or if the surge cannot be avoided, for bringing the compressor 11 out of surge. The open loop control module takes over the control of the anti-surge valve 12 by generating an open loop control signal corresponding to a rapid opening of the anti-surge valve 12. That output will be selected by the high signal selector 36. After the surge event is terminated, the open loop control module 34 will begin to close the anti-surge valve 12. Similar to the case of the PID module 32, the high signal selector 36 prevents the open loop control module 34 from closing the anti-surge valve 12 to a valve opening smaller than the minimum valve opening.

The surge detector 22 detects the onset of a surge event based on the process conditions measured by the process measurement module 15. The onset of a surge event can be determined by monitoring, for example, the speed of the compressor 11, the rate of change of the suction pressure or the discharge pressure, the flow, etc. Once the onset of a surge event is detected, the surge detector 22 sends a surge signal to the low limit control module 40. Triggered by the surge signal, the low limit control module 40 generates and stores a new minimum valve opening signal which is established based on the valve position at the onset of the surge event.

Figure 4:
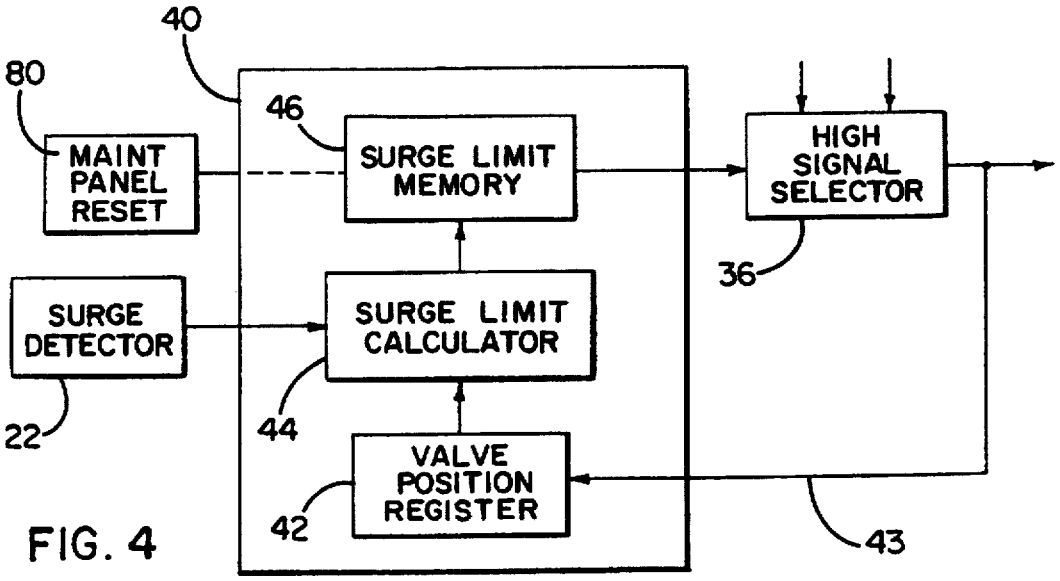
FIG. 4 is a block diagram showing an embodiment of the surge limit memory.

FIG. 4 shows an embodiment of the low limit control module 40. In this embodiment, the low limit signal is stored in a surge limit memory 46. The module 40 detects the valve opening at the surge onset by monitoring the output control signal from the high signal selector 36. For this purpose, the output control signal is coupled as a data input to a valve position register 42, which stores the output control signal as an indicator of the current valve opening. The module 40 has a surge limit calculator 44 which, upon being triggered by a surge signal from the surge detector 22, receives the signal stored in the valve position register 42 and establishes a new low limit for the valve position. The low limit calculator 44 then generates a new low limit position, which is stored in the surge limit memory 46 to replace the original low limit stored therein. The surge limit calculator 44 functions by adding a small increment delta (Δ) to the valve position in the register 42 (which corresponds to the valve position at the onset of surge). As noted above, the delta can be a fixed amount of valve opening. That calculated position is passed to the surge limit memory 46 for setting a new low limit for the surge control module.

Figure 5:
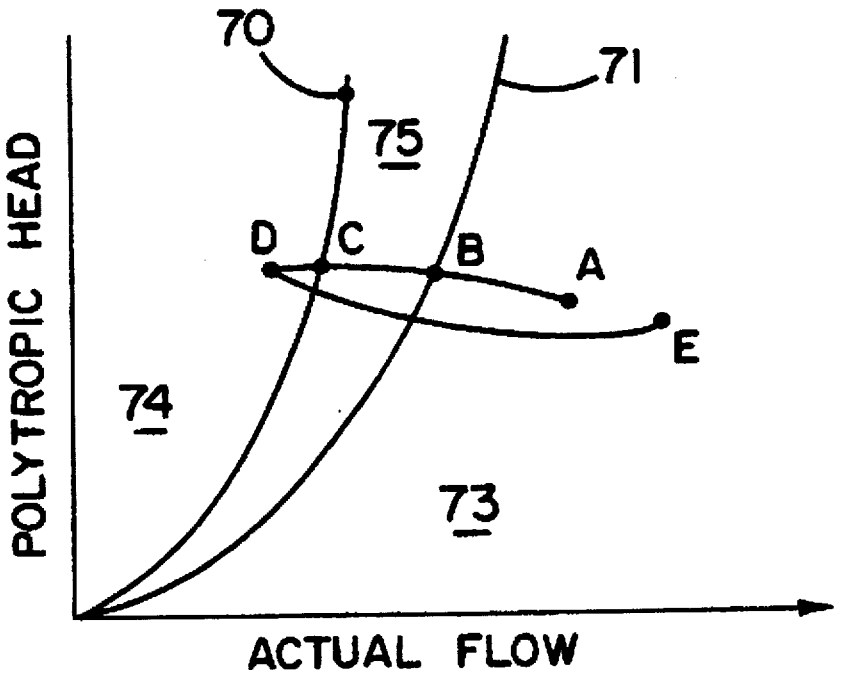
FIG. 5 shows a compressor map for a dynamic compressor and different positions of the operating point of the compressor in the compressor map.

The operation of the embodiment of the controller 20 shown in FIG. 3 will now be described using an example in conjunction with FIG. 5. FIG. 5 illustrates a compressor map of the compressor 11 defined by a vertical axis of polytropic head and a horizontal axis of actual flow through the compressor 11. The compressor map is divided by a surge line 70 into a surge region 74 and a stable region 73. A surge control line 71, which corresponds to the setpoint of the PID module 32, is disposed in the stable region 73 and is typically placed at a selected safety margin from the surge line 70.

Assume that the operating point of the compressor 11 is originally at point A, and that the minimum anti-surge valve opening is initially set to the fully closed position, i.e., zero opening. At point A, the PID module acts to close the anti-surge valve 12 so the anti-surge valve 12 is fully closed. Assume that due to a change in flow rate caused by, for example, changed conditions in the downstream process, the operating point moves towards the surge line 70. Once the operating point passes point B and moves into the region 75 between the surge control line 71 and the surge line 70, the PID module 32 acts to move the operating point away from the surge line 70 by opening the anti-surge valve 12.

Assume that the closed loop PID module 32 continues to control the anti-surge valve 12 but fails to prevent surge, and that the operating point continues to move towards the surge line 70. When the operating point moves past point C on the surge line to point D,, an actual surge event begins and the surge detector 22 detects the onset of the surge. The surge detector 22 then triggers the low limit control module 40 to detect the valve opening at the surge onset and establishes a new minimum valve opening according to the valve opening at the surge onset. For example, the new minimum valve opening may be set to be 5% larger than the valve opening at the onset of the surge event. After the surge begins, the open loop control module 34 takes over control of the anti-surge valve 12 by generating an open loop control signal corresponding to a large valve opening, such as the full opening of the anti-surge valve 12. The open loop control signal is selected by the high signal selector 36, and the anti-surge valve 12 is rapidly opened, which brings the operating point from point D to point E in the stable region 73 and terminates the surge event.

After the operating point is moved back to the stable region 73, both the PID module 32 and the open loop control module 34 begin to close the anti-surge valve. Due to the operation of the high signal selector 36, neither of the PID module 32 or the open loop control module 34 can reduce the valve opening below the new low limit valve opening. Thus, the anti-surge valve is maintained in the minimum valve opening position if the operating point stays in the region to the right of the surge control line 71. If another flow disturbance moves the operating point into the region 75, then the PID module will resist movement of the compressor operating point into the surge region by increasing the valve opening from the new low limit valve opening position.

In contrast to prior systems which rely on the anti-surge control modules, such as the PID, for maintaining an open position of the anti-surge valve under PID control, the present invention fixes a minimum opening position, and maintains that position until maintenance operations correct the problem. Thus, the low limit valve position signal which is coupled to the high signal select, prevents any of the controllers from closing the valve beyond the low limit. This condition will soon trigger a maintenance cycle on the system, which is intended to eliminate the conditions which caused the surge. When that is accomplished, a maintenance panel reset function 80 (see FIG. 4) is energized, preferably manually, to couple a reset signal to the low limit control module 40. As shown in FIG. 4, that reset signal is coupled to the surge limit memory 46, and serves to return the low limit to the zero, the valve closed position. In that condition, the compressor 11 will operate in the normal mode, with the anti-surge valve 12 normally closed, and operated under the control of the anti-surge controller to resist the occurrence of a surge condition. In the event of a surge, the minimum valve opening will be raised, as has been described above.

The surge prevention method according to the present invention for preventing recurrence of surge in a dynamic compressor 11 (FIG. 1) will now be described. The surge prevention method utilizes an anti-surge valve 12 (FIG. 1) which is coupled to the output of the compressor 11 and has an adjustable valve opening for bypassing flow around the compressor 11. To resist surge in the compressor 11, the method includes the step of continuously monitoring the process conditions of the dynamic compressor 11 and the step of controlling the valve opening between full open and a minimum valve opening according to the process conditions. The method further includes a step of detecting the onset of a surge event by monitoring the process conditions of the compressor 11. If the onset of a surge event is detected, a step of establishing a new low limit valve opening position is performed, which sets a new minimum valve opening according to the valve opening at the onset of the surge event. The steps are then repeated, and in the step of controlling the valve opening the anti-surge valve 12 is controlled to open and close between the full open and the new low limit valve opening.

In the preferred practice of the method of the present invention, the step of controlling the valve opening includes performing a closed loop PID control to exert control about a surge control line 71 (FIG. 5), and performing an open loop control in the event of surge to terminate the surge. The step of setting the low limit valve opening sets the new low limit to be slightly larger than the valve opening at the onset of the detected surge event. Preferably the new low limit valve opening is set to be larger than the valve opening at the onset of the surge event by a fixed amount of valve opening.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A control system for preventing recurrence of surge in a dynamic compressor having a variable operating point definable on a compressor map which includes a surge region, a stable operating region, a surge line separating said regions, and a surge control line in the stable operating region displaced from the surge line, the control system comprising:

an anti-surge valve having a valve opening adjustable for bypassing compressor flow, a surge detector for detecting onset of a surge event and generating a surge signal, a surge limit memory responsive to the surge signal for storing a valve position low limit related to the valve opening at the onset of the surge event, and a surge controller responsive to the operating point of the compressor for controllably opening the anti-surge valve from a minimum position to resist movement of the operating point into the surge region, the surge controller being operatively coupled to the surge limit memory for setting the minimum position to the stored low limit.

2. A control system as in claim 1, wherein the surge controller cooperates with the surge limit memory for storing a low limit equal to the valve opening at the onset of surge, plus an incremental Δ selected to prevent recurrence of surge.

3. A control system as in claim 2, wherein the Δ is a fixed amount of the valve opening.

4. A control system as in claim 1, wherein the surge controller includes a closed loop PID module having a setpoint corresponding to the surge control line and tuned to open the anti-surge valve when the operating point of the compressor is between the surge control line and the surge line.

5. A control system as in claim 4, wherein the surge controller includes a high signal selector receiving a plurality of inputs corresponding to valve position, the closed loop PID module being connected as one of said inputs, the surge event memory being connected as another of said inputs, the high signal selector selecting the input control signal corresponding to the largest valve opening for controlling the valve opening.

6. A control system as in claim 5, wherein the surge controller includes an open loop module for performing an open loop control cycle to rapidly open the valve, then slowly close the valve toward the stored low limit, the open loop module being connected to the high signal selector as one of said inputs.

7. A control system as in claim 6, wherein the open loop module is operative when the operating point of the compressor is in the surge region for restoring the compressor operating point to the stable operating region, the surge limit memory being responsive to store a new valve position low limit which is higher than the previously stored valve position low limit, and couple said new valve position low limit to the high signal selector for establishing a new lower valve limit.

8. A control system as in claim 7, further including a maintenance input comprising a reset input connected to the surge limit memory for manually restoring the valve position low limit to a zero valve opening after the surge condition is cured.

9. A control system as in claim 1, wherein the surge controller has two control modes:

(i) a quiescent mode in the stable operation region for maintaining the anti-surge valve at the stored low limit, and (ii) an anti-surge mode for controllably opening the anti-surge valve from the stored low limit to increase flow sufficiently to resist movement of the compressor operating point into the surge region.

10. A control system as in claim 9, wherein the anti-surge mode includes a cyclic mode for opening the valve sufficiently to return the operating point of the compressor to the stable operating region, and for reclosing the valve toward the stored low limit.

11. A control system for preventing recurrence of surge in a dynamic compressor having a variable operating point definable on a compressor map which includes a surge region, a stable operating region, a surge line separating said regions, and a surge control line in the stable operating region displaced from the surge line, the control system comprising:

an anti-surge valve having a valve opening adjustable for bypassing compressor flow, a surge detector for detecting onset of a surge event and generating a surge signal, a low limit control module having a data input related to the valve opening of the anti-surge valve and a control input operatively coupled to the surge detector for storing a valve position at the onset of the surge event, the low limit control module being responsive to the surge signal to store a new low limit related to the valve opening at the onset of the surge event to prevent recurrence of the surge event, a closed loop PID module for exerting control over the anti-surge valve when the compressor operating point reaches the surge control line, and a high signal selector coupled to the low limit control module and the PID control module, the high signal selector selecting the module corresponding to the largest valve opening as an output control signal for controlling the valve.

12. A control system as in claim 11, wherein the low limit control module includes means for adding a Δ increment to the data input so that the valve position which is stored corresponds to the valve position at the onset of surge plus the Δ increment.

13. A control system as in claim 12, wherein the Δ increment is a fixed amount of valve opening.

14. A control system as in claim 11, further including a maintenance accessible manually operable reset means for resetting the low limit control module to a minimum opening signal corresponding to a closed anti-surge valve after the surge condition has been corrected.

15. A method for preventing recurrence of surge in a dynamic compressor having a variable operating point definable on a compressor map which include a surge region and a stable operation region separated by a surge line, the method comprising the steps of:

providing an anti-surge valve having a valve opening adjustable for bypassing compressor flow, continuously monitoring the operating point of the compressor and temporarily opening the valve from a low limit minimum opening toward fully open to restrain the operating point from the surge region, detecting onset of a surge event, detecting the valve opening at the onset of the surge event, and increasing the low limit valve opening according to the valve opening position at the onset of the detected surge event.

16. A method as in claim 15, wherein the step of increasing the low limit valve opening increments said detected valve opening by an incremental Δ so that the low limit valve opening is slightly larger than the valve opening at the onset of the detected surge event.

17. A method as in claim 16, wherein the Δ is a fixed amount of valve opening.

18. A method as in claim 15, wherein the step of continuously monitoring includes performing a closed loop PID control to control the operating point of the compressor between the surge line and a surge control line in the stable region.

19. A method as in claim 18, wherein the step of continuously monitoring further includes performing an open loop control to control the valve opening to bring the compressor out of surge.

* * * * *